US009624607B2

(12) United States Patent
Keil

(10) Patent No.: US 9,624,607 B2
(45) Date of Patent: Apr. 18, 2017

(54) GRIPPER, TWISTING HEAD AND TWISTING DEVICE

(71) Applicant: SCHLEUNIGER HOLDING AG, Thun (CH)

(72) Inventor: Uwe Keil, Hueckeswagen (DE)

(73) Assignee: Schleuniger Holding AG, Thun (CH)

( * ) Notice: Subject to any disclaimer, the term of this patent is extended or adjusted under 35 U.S.C. 154(b) by 412 days.

(21) Appl. No.: 14/273,020

(22) Filed: May 8, 2014

(65) Prior Publication Data

US 2014/0331636 A1 Nov. 13, 2014

(30) Foreign Application Priority Data

May 8, 2013 (EP) ..... 13167060

(51) Int. Cl.
*D01H 7/04* (2006.01)
*H01B 13/02* (2006.01)

(52) U.S. Cl.
CPC ..... *D01H 7/04* (2013.01); *H01B 13/0207* (2013.01); *D01H 2700/24* (2013.01)

(58) Field of Classification Search
CPC ..... D01H 7/04; H01B 13/0207
See application file for complete search history.

(56) References Cited

U.S. PATENT DOCUMENTS

| | | | |
|---|---|---|---|
| 831,729 | A | 9/1906 | Merry |
| 1,178,566 | A | 4/1916 | Wright |
| 1,333,147 | A | 3/1920 | Wright |
| 3,198,220 | A | 8/1965 | Scamberti |
| 3,540,110 | A | 11/1970 | Schwarz |
| 3,839,777 | A | 10/1974 | Puzio |
| 4,009,852 | A | 3/1977 | Bulanda et al. |
| 4,095,497 | A | 6/1978 | Radford et al. |
| 4,108,333 | A | 8/1978 | Falk et al. |
| 4,272,951 | A | 6/1981 | Vogelsberg |

(Continued)

FOREIGN PATENT DOCUMENTS

| | | | |
|---|---|---|---|
| CH | 673858 | A5 | 4/1990 |
| CN | 201594421 | U | 9/2010 |

(Continued)

OTHER PUBLICATIONS

EPO search report and written opinion from priority EPO application EP13167060, dated Oct. 11, 2013, in German.

(Continued)

*Primary Examiner* — Shaun R Hurley
(74) *Attorney, Agent, or Firm* — Davis & Bujold PLLC; Michael J. Bujold

(57) ABSTRACT

A gripper for electrical or optical lines (24, 24') such as wires, cables, line bundles, optical fibers has two gripper jaws (22, 22') movable relative to a counterbearing as well as relative to one another. Twisting heads (4) for twisting apparatuses for the lines (24, 24') are equipped with such grippers. The gripper and the twisting head (4) and the twisting apparatus are provided with a drive arrangement including at least one adjustable-force drive (17) that acts via a link chain (15, 19, 19', 20, 20') on gripper jaw (22, 22'). The link chain (15, 19, 19', 20, 20') in this case has a section (19, 19') movable parallel to the drive (17), but in the opposite direction of movement.

20 Claims, 4 Drawing Sheets

(56) References Cited

U.S. PATENT DOCUMENTS

| | | | | |
|---|---|---|---|---|
| 4,506,566 | A | 3/1985 | Schmid | |
| 4,655,107 | A | 4/1987 | Juergenhake | |
| 4,699,414 | A | 10/1987 | Jones | |
| 4,744,596 | A * | 5/1988 | Hiller | B23Q 3/1554 294/115 |
| 4,800,791 | A | 1/1989 | Jürgenhake | |
| 5,033,785 | A | 7/1991 | Wooley, Jr. | |
| 5,100,021 | A | 3/1992 | Mussi et al. | |
| 5,222,859 | A | 6/1993 | Gepfert et al. | |
| 5,247,732 | A | 9/1993 | Lait et al. | |
| 5,253,912 | A | 10/1993 | Andorlini et al. | |
| 5,282,717 | A | 2/1994 | Lohr et al. | |
| 5,350,101 | A | 9/1994 | Godlewski | |
| 5,412,855 | A | 5/1995 | Koch | |
| 5,650,181 | A | 7/1997 | Kotaki | |
| 5,716,020 | A | 2/1998 | Shults | |
| 5,816,384 | A | 10/1998 | Hsu | |
| 5,820,008 | A | 10/1998 | College | |
| 5,946,897 | A * | 9/1999 | Ichikawa | H01B 13/0207 140/149 |
| 5,960,622 | A | 10/1999 | Koch et al. | |
| 6,135,164 | A | 10/2000 | Celoudoux et al. | |
| 6,167,919 | B1 | 1/2001 | Füchsl et al. | |
| 6,289,944 | B1 | 9/2001 | Frommenwiler | |
| 6,401,442 | B1 | 6/2002 | Root et al. | |
| 6,435,336 | B1 | 8/2002 | Knodler | |
| 6,490,785 | B1 | 12/2002 | Kometani | |
| 6,662,987 | B2 | 12/2003 | Erni | |
| 6,702,099 | B2 | 3/2004 | Otaguro et al. | |
| 6,735,933 | B2 | 5/2004 | Abba et al. | |
| 6,948,675 | B2 | 9/2005 | Frommenwiler | |
| 6,999,847 | B2 | 2/2006 | Barry et al. | |
| 7,021,510 | B2 | 4/2006 | Ellingson | |
| 7,043,825 | B2 | 5/2006 | Conte | |
| 7,178,708 | B2 | 2/2007 | Grinsted | |
| 7,647,759 | B2 | 1/2010 | Braun et al. | |
| 8,002,784 | B2 * | 8/2011 | Jinno | A61B 17/29 606/174 |
| 8,113,557 | B2 | 2/2012 | Kirst et al. | |
| 8,234,850 | B1 | 8/2012 | Wright | |
| 8,573,656 | B1 | 11/2013 | Zhang et al. | |
| 8,646,822 | B2 | 2/2014 | Braun et al. | |
| 9,078,479 | B2 | 7/2015 | Wright | |
| 2005/0050713 | A1 | 3/2005 | Locher et al. | |
| 2005/0132853 | A1 | 6/2005 | Hattersley et al. | |
| 2006/0263194 | A1 | 11/2006 | Ahlers et al. | |
| 2009/0241314 | A1 | 10/2009 | Watanabe | |
| 2011/0049211 | A1 | 3/2011 | Schütz et al. | |
| 2014/0352867 | A1 | 12/2014 | McClane et al. | |

FOREIGN PATENT DOCUMENTS

| | | | |
|---|---|---|---|
| DE | 3630359 | A1 | 3/1988 |
| DE | 4104597 | A1 | 10/1991 |
| DE | 19624973 | A1 | 1/1998 |
| DE | 19631770 | A1 | 2/1998 |
| DE | 19844416 | A1 | 4/1999 |
| DE | 10107670 | A1 | 9/2002 |
| DE | 102010017981 | A1 | 10/2010 |
| EP | 0303724 | A1 | 2/1989 |
| EP | 0598276 | A1 | 5/1994 |
| EP | 0708050 | A1 | 4/1996 |
| EP | 0788200 | A2 | 8/1997 |
| EP | 0984530 | A1 | 3/2000 |
| EP | 1009074 | A2 | 6/2000 |
| EP | 1032095 | A2 | 8/2000 |
| EP | 1213800 | A1 | 6/2002 |
| EP | 1387449 | A1 | 2/2004 |
| EP | 0889486 | B1 | 8/2004 |
| EP | 1447888 | A1 | 8/2004 |
| EP | 1691457 | A1 | 8/2006 |
| EP | 1032095 | A3 | 5/2008 |
| GB | 868532 | A | 5/1961 |
| JP | 2004-071237 | A | 3/2004 |
| WO | 93/06320 | A1 | 4/1993 |
| WO | 2009/141794 | A2 | 11/2009 |
| WO | 2011/055336 | A1 | 5/2011 |
| WO | 2012/015057 | A2 | 2/2012 |
| WO | 2013/068981 | A1 | 5/2013 |
| WO | 2013/068984 | A1 | 5/2013 |
| WO | 2013/068986 | A1 | 5/2013 |
| WO | 2013/068988 | A1 | 5/2013 |
| WO | 2013/068990 | A1 | 5/2013 |

OTHER PUBLICATIONS

Copending commonly-owned U.S. Appl. No. 14/357,222 entered U.S. national phase May 11, 2014.

Copending commonly-owned U.S. Appl. No. 14/357,226 entered U.S. national phase May 11, 2014.

Copending commonly-owned U.S. Appl. No. 14/357,248 entered U.S. national phase May 11, 2014.

Copending commonly-owned U.S. Appl. No. 14/357,264 entered U.S. national phase May 11, 2014.

* cited by examiner

GRIPPER, TWISTING HEAD AND TWISTING DEVICE

This application claims benefit of priority to prior European (EPO) application no. EP13167060 filed on May 8, 2013, and the entirety of European application no. EP13167060 is expressly incorporated herein by reference in its entirety, for all intents and purposes, as if identically set forth in full herein.

BACKGROUND

The present disclosure relates to grippers for electrical or optical lines such as wires, cable, line bundles, optical fibres; to twisting heads for the twisting of such electrical or optical lines; as well as to twisting apparatus for the twisting of such electrical or optical lines.

A typical configuration of such a gripper has at least one gripper jaw that can be moved relative to a counterbearing by means of a drive arrangement. Preferably provided are two gripper jaws that may be moved relative to one another. Such gripper is used in twisting heads that are typically provided in twisting apparatus for example, for wires, cables, line bundles, optical fibres etc., and at the same time can be rotated by at least one drive.

DE 1 0201 001 7981 A1 discloses a device for combining conductors to produce a double crimp connection. The (double) grippers used therein possess gripper arms held in a guide, which are displaceable vertically to the gripper plane.

EP 1032095A1 relates to processing and twisting of a pair of conductors. The grippers as a whole are individually pivotable by a lever mechanism associated with a pivoting unit. However, the gripping of the wire is not accomplished by the lever mechanism shown.

EP 1691457A1 discloses an untwisting unit associated with a cable processing device. A gripper is driven pneumatically (for example, closed pneumatically and opened by means of spring force).

U.S. Pat. No. 4,272,951A discloses a twisting apparatus in which the twisting is accomplished by a roller or belt arrangement that embraces the wires to be twisted from two sides. In this case, these rollers or belt arrangement may be twisted. A completely different principle is involved in this reference.

U.S. Pat. No. 5,605,181A discloses a portable twisting tool wherein the wires to be twisted are clamped by an apparatus at the centre of their length. At their ends the wires are fixed stationarily by fastening devices. The twisting apparatus consists of a sleeve having an elongated cut-out into which a part is inserted which sits on a second sleeve and projects between the two wires.

DE 10107670A1 discloses a twisting head having three gripper jaws that can be moved relative to a counterbearing, and that are opened or closed via a mechanical link chain by a drive in the form of a fluidic working cylinder. In this case, the gripper jaws move with their front end radially in relation to the line to be clamped, whereas the drive acts predominantly parallel to the line.

All the solutions known in the prior art have in common that they are mechanically complex and have a high weight. Twisting apparatuses are therefore very expensive, and the drive requirement is high. In addition, the holding force for line ends is not adjustable.

SUMMARY

An object of the present disclosure is to provide gripper, twisting head, and twisting apparatus mitigating these disadvantages and allowing two or more, possibly contacted line ends to be gripped automatically and be held securely. The lines may be twisted into one another at high rotational speed. In this case, in particular, the problem of achieving the twisting function with all automatic mechanisms is to be solved, simultaneously obtaining low mass of the twisting head and simple and cost-effective structure. The gripper mechanics should hold the lines securely with an adjustable holding force independently of occurring centrifugal forces, without expensive exchange or adaptation work.

Advantageous further developments are set out in the following disclosure and appended figures.

This present disclosure achieves this object with a gripper whose drive arrangement includes at least one drive having adjustable force, that acts via a preferably mechanical link chain on the, or each, gripper jaw, whereby the chain of links has a section parallel to the drive that is movable in the opposite direction relative to the drive. Preferably a mechanical link chain, that is a chain or sequence of mechanical links, is employed. As a result of these features, based on the parallel and closely adjacent positioning, a compact arrangement of gripper and drive may be achieved.

The ratio of drive force to holding force is precisely defined by the specified lever ratios of the link chain. Therefore the holding force on the line may be adjusted precisely by adjustment of the drive force that is transferred indirectly via the link chain in a precisely determinable manner to the holding jaws, so that the optimal gripper closing force for the secure gripping and holding of the line ends may be adjusted as a function of line cross-section and line quality. The programmable value of the adjusting parameters can be ascribed to the respective situation of application, and stored at any time, so that it may be retrieved again. This enables an automatic setting up of the twisting process without manual equipping/setting up of components of the gripper, nor of the twisting head using this gripper. In particular, the drive force may be preselected per program, stored matched to production parameters, and retrieved again at any time. No power or signal lines are required to the gripper, which is typically part of a rotating twisting head.

A preferred example for a drive with adjustable force is a fluidic working cylinder having programmable supply pressure. Preferably pneumatic cylinders may be employed for this purpose. The supply pressure of a pneumatic cylinder and therefore its drive force may be programmed adjustably by a suitable selectable control valve. The holding force of the gripper jaws may thus be set precisely via the link chain with precisely defined force transmission ratio.

Preferably, the direction of movement of the gripper jaws has a predominant component radially in relation to the line for the purpose of a good holding effect and force direction. Preferably, the direction of movement runs precisely radially in relation to the line. A reference to "the line" here and also throughout the following text is also a designation of that location in the apparatus and that direction in the gripper or the apparatus, or parts of apparatus, being defined in detail by this term, at which the processed material line such as electrical or optical lines, for example such as wires, cable, line bundles, optical fibres, to be gripped lies or is oriented.

An advantageous version of the gripper according to the present disclosure may be further characterised in that the direction of action of the drive is predominantly effected parallel in relation to the line, where via the link chain, a force deflection into a direction of action in the direction of the movement direction of the gripper jaws is provided. With this feature, a very compact arrangement of gripper and drive is possible. Consequently, gripper and drive may be positioned parallel and closely adjacent to one another.

For a twisting head, the initially formulated object is solved by the disclosed features, whereby the gripper is configured according to any one of the preceding paragraphs, and the corotating section of the link chain is formed by elements movable parallel to the drive, and opposite to the direction of movement of the drive and by the or each gripper jaw. These features ensure a compact, space-saving and secure structure of the twisting head. As a result of the deflection of the drive effect from the drive onto the gripper by substantially 180°, the drive and a long section of the link chain may be disposed parallel. Such a parallel arrangement enables a short overall length of the arrangement. The drive of the gripper is, in this case, disposed in a fixed position, which contributes to a very simple, compact and also light structure of the twisting head. The heavy drive need not be co-moved with the twisting head and/or the gripper, which also substantially simplifies the supply with power and operating means. This twisting head design enables a fully automatic twisting process of line pairs that have already been cut to length and contacted on both sides, with very good shielding or damage protection of the contacted line ends.

For a simple, compact and reliable structure, it is preferably provided in both variants of the twisting head that the link chain include a positionally fixed deflecting lever, via which the drive acts on the movable elements of the link chain. Particularly advantageous for the distribution and introduction of force is the configuration of the deflecting lever as a fork lever. In order to minimize friction losses, an axial roller bearing can be interposed between lever and link chain. Alternatively or additionally, the installation of a pressure ring that can be positioned coaxially to the line is provided.

The movable elements and the/(or each) gripper jaw are mounted on a corotating, preferably pot-like supporting structure. This has at least one recess extending parallel to the direction of the lines in such a dimension and shape that the lines can be removed. Such a design allows a large, largely cylindrical chamber interior with a relatively thin outer shell of the twisting head compared to the relatively small receiving volume of conventional grippers or twisting heads having mostly higher weight.

In this case, it may be particularly advantageous if a tubular sleeve be provided as a cover coaxially to the supporting structure, the tubular sleeve having at least one recess extending parallel to the direction of the line for removal of the lines. This tubular sleeve in this case corotates either with the twisting head or is locked in a non-rotatable position. The corotating tubular sleeve together with a pot-like supporting structure can form an optimal circumferentially closed shielding of the twisting region. When locked in a non-rotatable position, the recesses can be brought to overlap by relative twisting of supporting structure and tubular sleeve and a loading and removal opening is thereby exposed. It is thereby possible to avoid components that, in the opened state of the gripper, were splayed very widely outwards so that there was a risk of collision when the rotational movement was accidentally started up, in particular during the referencing travel of the system. As a result of the opening and closing of the receiving chamber for the lines by means of the tubular sleeve, a secure processing and simple loading and ejection of the line is ensured through a compact and simple design.

A further version of the twisting head according to the invention is characterised in that the gripper jaws consist of a metal material. Preferably, hard-anodized aluminium may be used for this purpose. Furthermore, a fluting or roughening of the gripper surfaces may be provided, at best a plasma-coated surface, or also other surface structures. The surfaces of the gripper jaws gripping the lines may also be formed at least partially from an elastic material, particularly preferably from an elastomer. Preferably, at least the surfaces coming in contact with the lines to be gripped are covered with hard material particles such as, for example, corundum. Gripper jaws affected by wear may thereby be exchanged simply and independently of the other elements of the twisting head. The hard material particles improve still further the very good fixation holding of the lines to be twisted, as a result of the aforementioned features.

According to an advantageous variant of this version of the twisting head, an elastic support, preferably a textile, is fastened on the gripper jaw. The support itself is preferably fastened on the gripper jaw that may advantageously be (but is not limited to) elastic material, and hard material particles which are present in any case are located on the support. As a result, with optimal holding effect and low-wear structure due to the elastic support, in a cost-saving manner only the uppermost layer coming in contact with the line ends may be covered with the adhesion-promoting layer.

The initially mentioned object may also be achieved by a twisting apparatus that is characterised in that the twisting head is designed according to at least one of the preceding paragraphs relating to the twisting head, wherein a second drive is a rotary drive which transfers the drive moment via a preferably annular drive means to a shaft of the twisting head. The second drive is used for the rotating movement of the twisting head whereas the first drive effects the movement of the gripper jaws.

It is preferably provided in this case that the output shaft of the second drive be disposed laterally at a distance and parallel to the axis of rotation of the twisting head. The same applies in a preferred further variant for the motor shaft.

Overall, as a result of the individual features, a very compact structure of the gripper, therefore also of the twisting head and the entire twisting apparatus, may be achieved. The small number of parts and/or the low moving mass enables highly dynamic processes, where as a result of the largely rotationally symmetrical structure of the rotating parts, these can be simply balanced for low-vibration operation. In addition, the preferably cylindrical structure of the rotating assembly of gripper and twisting head without outwardly projecting components considerably reduces the risk of collision with neighbouring components and also reduces the control expenditure which would be required otherwise to eliminate risks of collision. Also, there are no components mounted externally in the rotating assembly, as at high rotational speeds and centrifugal forces, such could produce a hazard by slinging away.

The very compact structure with a preferably tubular housing of the twisting head allows a very large amount of space for the automatic insertion or ejection of the line ends from, or in, a substantially cylindrically constructed twisting chamber that has a large receiving chamber volume for the line ends equipped with seal and contacts.

The gripper jaws may be exchanged very easily, and preferably a large capturing region for lines is integrated at the end plate of the twisting rotor. In this case, the edges of the capturing region on the twisting head, in particular on the front-side end plate of the twisting head, may act as stripper edges in order to strip line ends safely from the gripper jaws.

Further advantages, features and details of the invention are obtained from the following description in which exemplary versions are described with reference to the drawings. Some exemplary possible realizations of versions according to the present disclosure may be understood in greater detail on the basis of the attached drawings and accompanying description, without restricting the claimed scope of protection to specific exemplary disclosure.

The appended list of reference labels is part of the present disclosure. The figures are described cohesively and in an overlapping manner. In the drawings, the same reference labels denote the same components, and reference symbols with different indices specify functionally the same or similar components.

DETAILED DESCRIPTION

Figure 1:
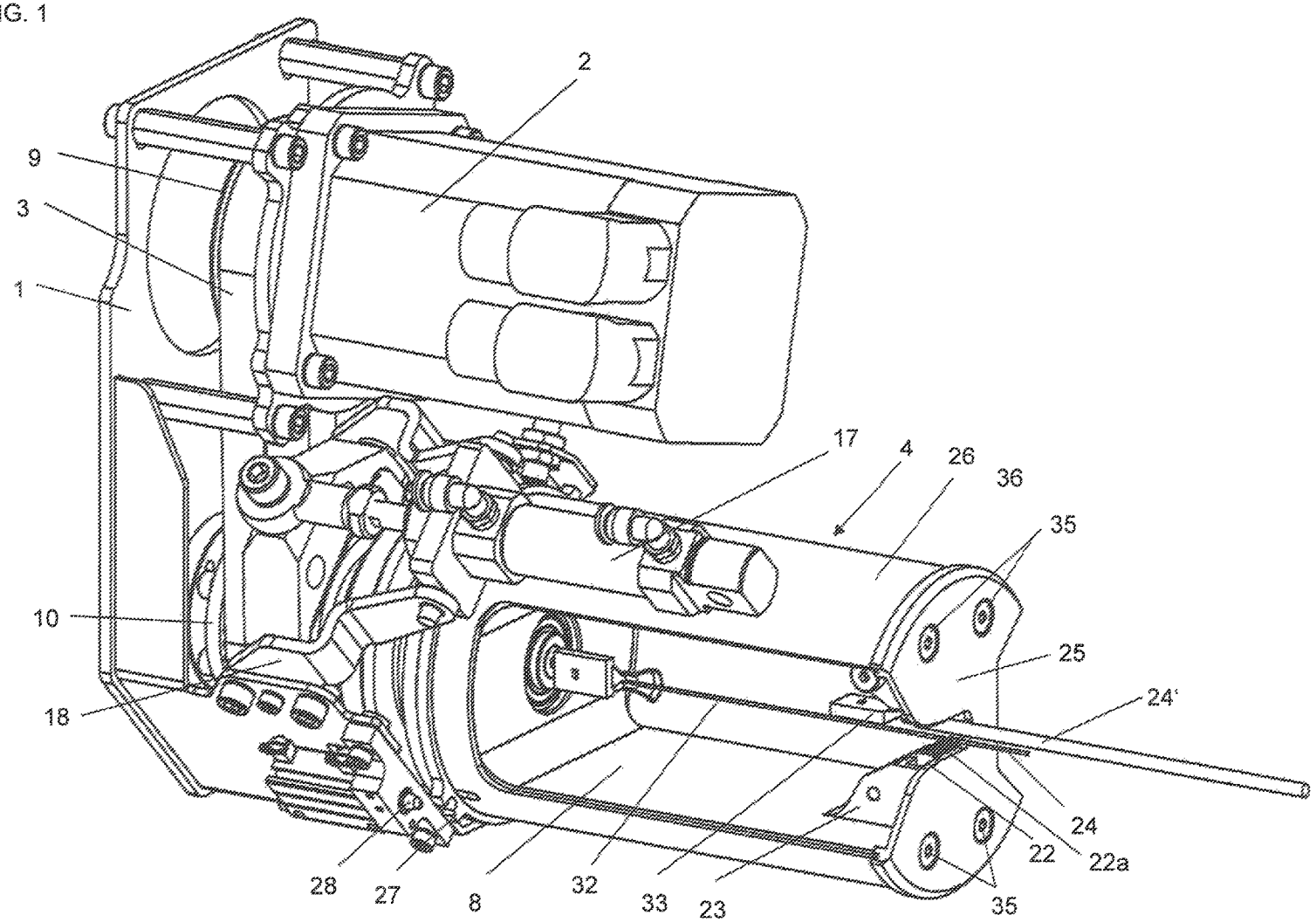
FIG. 1—depicts an exemplary twisting head in a perspective overall view, with opened insertion or injection region.

In the present description, numerous specific details are set forth in order to provide a thorough understanding of versions of the present invention. It will be apparent, however, to one skilled in the art, that some versions of the present invention may be practiced without some of these specific details. Indeed, reference in this specification to "one/the version," "a version," "versions," "a variant," "variants," and "one/the variant," should be understood to mean that a particular feature, structure, or characteristic described in connection with the version or variant is included in at least one such version or variant of the disclosure. Thus, the appearances of phrases such as "in one version," "in one variant," and the like, in various places in the specification are not necessarily all referring to the same variant or version, nor are separate or alternative versions or variants mutually exclusive of other versions or variants. Moreover, various features are described which may be exhibited by some versions or variants and not by others. Similarly, various requirements are described which may be requirements for some versions or variants, but not others. Furthermore, as used throughout this specification, the terms 'a', 'an', 'at least' do not denote a limitation of quantity, but rather denote the presence of at least one of the referenced item, in the sense that singular reference of an element does not necessarily exclude the plural reference of such elements. Concurrently, the term "a plurality" denotes the presence of more than one referenced items. Finally, the terms "connected" or "coupled" and related terms are used in an operational sense and are not necessarily limited to a direct connection or coupling.

A twisting apparatus as in the depicted exemplary version of FIGS. 1-4 includes a base frame 1 to which at least one drive motor 2, being preferably a servo drive, for the twisting head 4, is attached. Via, for example, a drive belt 3, preferably a toothed belt, the drive motor 2 drives the twisting head 4 with the actual gripper 11, 15, 16, 17, 19, 19', 20, 20', 22, 22' comprising a plurality of assemblies (see on this matter in particular FIG. 2). It should be readily understandable that within the framework of the present disclosure, other drives or other transmission elements may also be provided between drive motor 2 and twisting head 4. Alternatively, a second twisting head may additionally be provided and may preferably be actuated by the same drive motor 2.

A first toothed disk 9 fastened to the drive shaft (not visible) of the drive motor 2 transmits, via the toothed drive belt 3, the rotational movement via a second toothed disk 10 to the rotatably mounted twisting head 4 preferably positioned parallel to the drive motor 2, which also includes the rotatably mounted twisting head housing 8. Also visible in FIG. 1 are one gripper jaw 22 of the two gripper jaws 22, 22' provided, and also two lines 24, 24' to be twisted having free excess lengths 32, 33 of various length. Alternatively, a coaxial arrangement of the drive motor 2 and the twisting head 4 is also possible. The torque transmission from the drive motor 2 to the twisting head 4 is then preferably accomplished by means of a coupling have a stable rotational angle.

Figure 2:
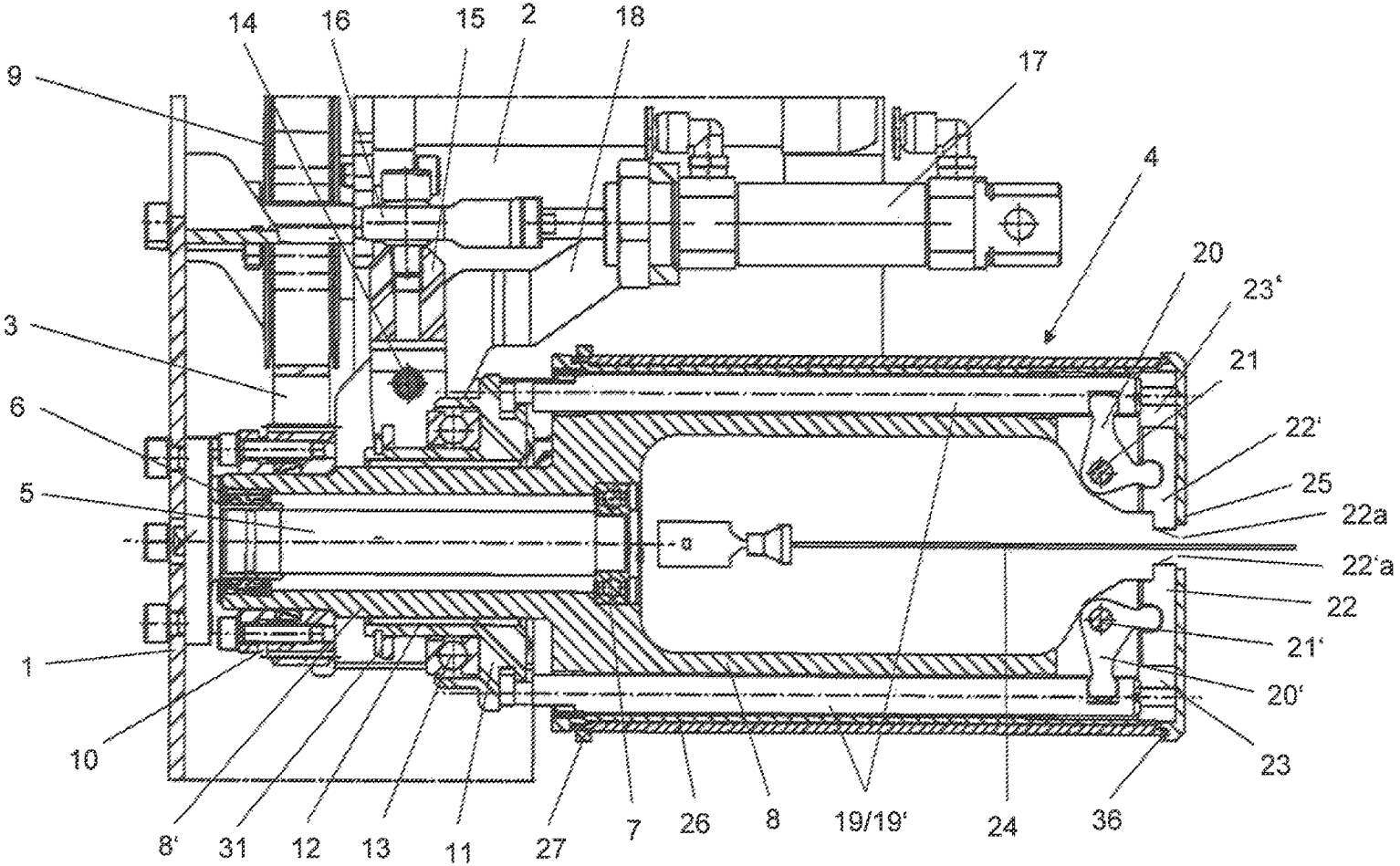
FIG. 2—depicts the twisting head of FIG. 1 in a partially cutaway overall view in longitudinal section.

The second gripper jaw 22' cannot be identified in FIG. 1 since, concealed by a front-side end plate 25, it is located—as can be seen, for example, in FIG. 2 —opposite the first gripper jaw 22 in relation to the lines 24, 24'. The lines 24, 24' are clamped between the two gripper jaws 22 and 22' for the twisting. The stroke of the gripper jaws 22, 22' is sufficient for clamping and holding the entire line cross-sectional region for which the twisting apparatus is designed. The gripper jaws 22, 22' are guided in linear guides 23, 23' in the front region of the twisting head housing 8.

For changing the gripper jaws 22, 22' the front-side end plate 25 of the twisting head 4 can be dismounted very simply by loosening screws 35. The end plate 25 also contains, along at least a part of its circumference, circumferential guide grooves 36 for a tubular sleeve 26 that, over at least a part of the circumference of the twisting head housing 8, surrounds on the outside. Also shown is a locking ring 27 of the tubular sleeve 26 on its side facing the base frame 1, and one of two locking tappets 28 attached in a fixed position relative to the base frame 1. These locking tappets 28 provided on the circumference may be shifted automatically, preferably actuated pneumatically. In a locking position locking tappets 28 engage in structures of the locking ring 27, in this manner fixing the tubular sleeve 26 in its position against twisting relative to the base frame 1. In the withdrawn position of the locking tappets 26, the tubular sleeve 26 may be rotated freely with the twisting head housing 8.

FIG. 2 depicts the twisting head 4 in a partially cutaway overall view along the axis of rotation that coincides with an axis 5 fixed to the frame. Here it can be seen how the twisting head housing is mounted, as a pot-like supporting structure 8, by a first roller bearing 6 and a second roller bearing 7 on the axis 5 fixed to the frame. Via the holder 18 a pneumatic cylinder 17 as a drive for the assemblies forming the grippers 11, 15, 16, 17, 19, 19', 20, 20', 22, 22' of the twisting head 4 is preferably also, in a manner, fixed to the frame. The piston rod of this pneumatic cylinder 17 actuates via the pivot bearing 16 a fork-shaped lever 15 that is pivotally mounted on a pivot axis 14. Bolts 30 and 30' (not shown in FIG. 2, see FIG. 3 for this subject matter) are fastened to the fork ends of the lever 15.

Figure 3:
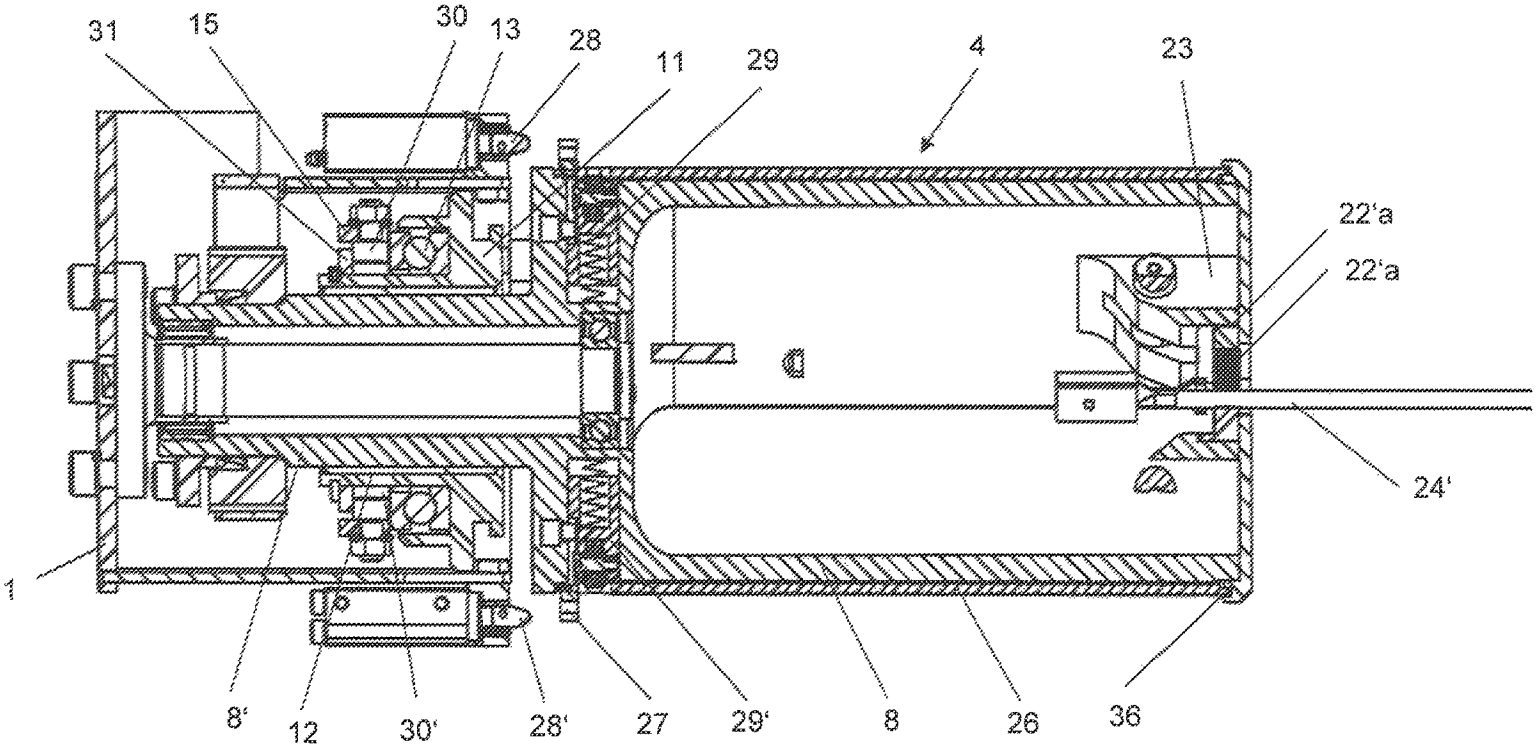
FIG. 3—depicts a longitudinal section through the twisting head of FIGS. 1 and 2, in a plane rotated about the longitudinal axis with respect to FIG. 2; and, FIG. 4—depicts the twisting head of FIGS. 1 to 3 with downwardly directed but closed insertion or ejection region.
Figure 4:
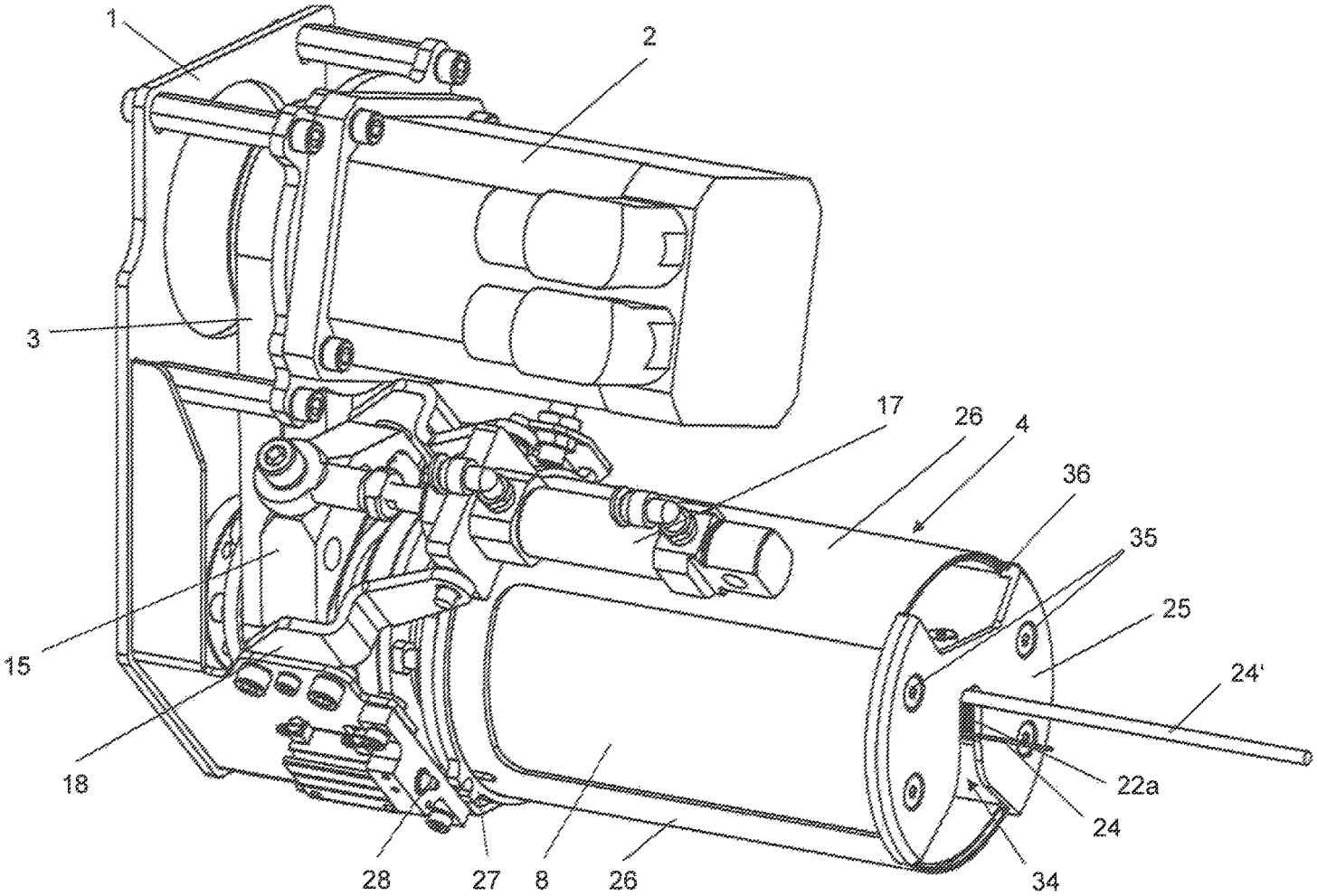

As may be observed from the enlarged longitudinal section of FIG. 3, the bolts 30, 30' dip into the region between an axial rover bearing 13 and a ring 31. This axial rover bearing 13 is mounted on one side on a pressure ring 11. The opposite side of the axial roller bearing 13 on which side the bolts 30, 30' can act is freely rotatable. The pressure ring 11 is mounted, axially displaceable, by a plain bearing 12 on a tubularly lengthened region (tubular extension or shaft 8')of the twisting head housing 8.

As can also be observed from FIG. 2, the pressure ring 11 is located in engagement with two rods 19, 19' that are mounted axially displaceably in the twisting head housing 8. Rods 19, 19' extend along the length of the twisting head housing 8, and, on the side of the twisting head housing 8 opposite the pressure ring 11, are located in engagement with respective first lever arm ends of respective angle levers 20, 20'. The angle levers 20, 20' are pivotably mounted on their respective pivot axes 21, 21', and at their respective second lever arms in turn engage their respective second lever arm ends within respective recesses in the respective gripper jaws 22, 22'.

The gripper jaws 22, 22' are guided in their longitudinal direction in linear guides 23, 23' of the twisting head housing 8. The gripper jaws 22, 22' grip and hold the line 24, 24' when the piston rod of the pneumatic cylinder 17 extends and via the pivot bearing 16 of the fork-shaped lever 15 mounted on the pivot axis 14 presses, via the bolts 30, 30' fastened to the fork ends, on the axial roller bearing 13 and therefore on the pressure ring 11. The pressure ring 11 exerts a compressive force on the rods 19, 19' mounted displaceably in the twisting head housing 8. The rods 19, 19', via the angle levers 20, 20' mounted pivotally on the pivot axes 21, 21', transfer a corresponding force to the gripper jaws 22, 22' in the longitudinal direction thereof, that is, substantially radially to the lines 24, 24'. Consequently, the lines 24, 24' are clamped between the gripper jaws 22, 22'. In this case, the gripper force is approximately the same over the entire gripping range of the pair of gripper jaws 22, 22' since this is determined by the pressure of the pneumatic cylinder 17. Consequently, it is relatively easy to set up the twisting process before the parameters for the twisting process are stored.

FIG. 3 shows, in section, the bolts 30, 30' fastened to the fork ends of the lever 15 in their position between the axial roller bearing 13 and another ring 31 fastened to the pressure ring 11. For closing the gripper jaws 22, 22', the lever 15 presses via the bolts 30, 30' on the freely rotatable ring of the axial roller bearing 13. The twisting head 4 is only set in rotation when the gripper jaws 22, 22' are closed, which is ensured by a corresponding control/sensor system.

For opening the gripper jaws 22, 22', the bolts 30, 30' press against the back ring 31 seated around the pressure ring 11 in turn mounted displaceably on the twisting head housing 8. This movement is also effected by the pneumatic cylinder (fluid pressure working cylinder) 17. The working strokes thereof in at least one direction may also be supported by an elastic element, for example, a spring element, In this position the gripper jaws 22, 22' are open, and no twisting process takes place. In addition, FIG. 3 shows the spring-mounted pressure bolts 29, 29' that secure the tubular sleeve 26 against twisting in the two rotational angle positions with respect to the twisting head housing 8 laterally open or closed.

FIG. 4 again shows the twisting head 4 in a perspective overall view, this time with a downwardly directed insertion or ejection region 34 of the end plate 25, and likewise includes depicted lines 24, 24'. In this position, the tubular sleeve 26 closes the interior of the twisting head housing 8 at its circumference. This closed position of the twisting head 4 is approached before the twisting process. The locking tappets 28 are then withdrawn, and the twisting process is carried out with the twisting head housing 8 closed. For ejection of the lines 24, 24' after the twisting process, the twisting head 4 is stopped at an angle of 90° before the ejection position. The tubular sleeve 26 is then fixed by means of the locking tappets 28 and the locking ring 27. The twisting head 4 is then turned further by 90°. As a result of this process, the tubular sleeve 26 is also twisted by 90° with respect to the twisting head housing 8, so that the side openings of the twisting head housing 8 are now open again. Now after the opening of the gripper jaws 22, 22', the, for example, pairwise twisted lines 24, 24' may drop downwards from the twisting head housing 8, for example onto a collecting surface due to gravity.

Advantageously, clamping surfaces of the gripper jaws 22, 22' may be withdrawn behind the edges of the insertion region 34 during opening, so that these edges act as forcible ejectors of the ends of the lines 24, 24'. Lines 24, 24' possibly adhering to the gripper jaws 22, 22' with their insulation are thereby reliably stripped for ejection, and any disturbances in the process may thereby be prevented. Thus, the drive mechanism of the gripper jaws 22, 22' is designed so that during opening these are reliably withdrawn behind the edges of the line collecting region, as in particular the end plate 25 and the lines 24, 24' are thereby safely raised from the gripper jaws 22, 22' for positive removal/ejection. Experience teaches that some line insulating materials may sporadically remain adhering to the gripper jaws. This would then results in disturbances in the sequence.

The preferably exchangeable gripper jaws 22, 22' preferably may be of an elastomer, and are covered on their surfaces 22a, 22'a or also homogeneously in the material with hard material particles (e.g., corundum) to form roughened gripper surfaces and thereby increase the frictional force. The hard material particles may be applied directly to the elastomer, for example by fusing or dissolving the elastomer; or they may be glued on directly; or they may be located on an elastic intermediate support (textile) that in turn is glued to the elastomer.

The invention is not restricted to the exemplary version shown. The various drives of the moving parts may be implemented in various ways, for example, using pneumatic or hydraulic working cylinders, electric motors, magnetic drives, or the like. Also the transmission of force may be accomplished by means of various endless and closed force transmissions such as belts, toothed belts, chains, etc.

Finally, it should be noted that the term "comprising" does not exclude other elements or features, and that use of the terms "a" or "an" does not necessarily exclude a plurality, in the sense that singular reference of an element does not exclude the plural reference of such elements. The verb 'comprise' and its conjugations do not exclude the presence of elements or steps other than those listed in any claim or the specification as a whole. The mere fact that certain measures are recited in mutually different dependent claims does not indicate that a combination of these measures cannot possibly be used to advantage. Furthermore, elements described in association with different versions may be combined. Finally, it should be noted that the above-mentioned examples, and versions illustrate rather than limit the invention, and that those skilled in the art will be capable of designing many alternative implementations without departing from the scope of the invention as defined by the appended claims. As equivalent elements may be substituted for elements employed in claimed invention to obtain substantially the same results in substantially the same way, the scope of the present invention is defined by the appended claims, including known equivalents and unforeseeable equivalents at the time of filing of this application. Thus, in closing, it should be noted that the invention may not be merely limited to the abovementioned versions and exemplary working examples. Further developments, modifications and combinations are also within the scope of the appended patent claims and are placed in the possession of the person skilled in the art from the present disclosure. Accordingly, the techniques and structures described and illustrated previously herein should be understood to be illustrative and exemplary, and not necessarily limiting upon the scope.

List of Reference Labels

| | |
|---|---|
| 1 | Base frame |
| 2 | Drive motor |
| 3 | Toothed drive belt |
| 4 | Twisting head |
| 5 | Axis fixed to frame |
| 6 | First roller bearing |
| 7 | Second roller bearing |
| 8 | Pot-like twisting head housing |
| 8' | Tubular extension |
| 9 | First toothed disk |
| 10 | Second toothed disk |
| 11 | Pressure ring |
| 12 | Plain bearing |
| 13 | Axial roller bearing |
| 14 | Pivot axis |
| 15 | Lever |
| 16 | Pivot bearing |
| 17 | Pneumatic cylinder |
| 18 | Holder |
| 19, 19' | Pressure rod |
| 20, 20' | Angle lever |
| 21, 21' | Second pivot axis |
| 22, 22' | Gripper jaws |
| 23, 23' | Linear guide |
| 24, 24' | Line |
| 25 | Front-side end plate |
| 26 | Tubular sleeve |
| 27 | Locking ring |
| 28, 28' | Locking tappet |
| 29, 29' | Spring-mounted pressure bolt |
| 30, 30' | Bolt |
| 31 | Ring |
| 32 | Line end |
| 33 | Line end |
| 34 | Insertion and ejection region |
| 35 | Screws |
| 36 | Guide grooves |

What is claimed is:

1. A twisting machine comprising:

a hollow cylindrical support structure, said hollow cylindrical support structure having a proximal end, and said hollow cylindrical support structure having a distal end;

a shaft connected to said proximal end of said cylindrical support structure;

a pressure ring disposed around said shaft, said pressure ring being reciprocatable relative to the shaft along an axis of rotation of said shaft;

a plurality of pressure rods extending from said proximal end of said hollow cylindrical support structure, said pressure rods being operatively connected to said reciprocatable pressure ring to reciprocate therewith, said pressure rods extending towards said distal end of said cylindrical support structure;

a plurality of respective angle levers each operatively connected with a respective one of said pressure rods at respective locations proximate to said distal end of said support structure, each of said angle levers having a respective first lever-arm end that respectively engages a respective one of said pressure rods; and, a plurality of movable gripper jaws situated proximate to said distal end of said hollow cylindrical support structure, said movable gripper jaws being mounted to controllably reciprocate radially relative to the axis of rotation of said shaft, each of said angle levers having a respective second lever-arm end that respectively engages a respective one of said gripper jaws to provide that controlled reciprocation of said pressure ring along the axis of rotation of said shaft controllably reciprocates said movable gripper jaws radially relative to the axis of rotation of said shaft.

2. A twisting machine as claimed in claim 1 further comprising:

said pressure ring having a proximal side; and, an axial roller bearing contacting said pressure ring proximal side to receive controlled thrust force along the axis of rotation of said shaft.

3. A twisting machine as claimed in claim 2 further comprising:

a pivotable lever operatively engaging said axial roller bearing to controllably reciprocate said pressure ring;

a drive cylinder, said drive cylinder having a piston rod extending therefrom in a direction from said distal end towards said proximal end; and, said piston rod being operatively connected to said pivotable lever to reciprocate said thrust bearing towards said proximal end when said piston rod is extended, and to reciprocate said thrust bearing away from said proximal end when said piston rod is retracted.

4. A twisting machine as claimed in claim 1 further comprising:

a tubular sleeve at least partly surrounding said hollow cylindrical support structure.

5. A twisting machine as claimed in claim 4 further comprising:

a locking ring on said tubular sleeve, said locking ring being located proximate to said proximal side; and, at least one controllably actuatable locking tappet configured to lock said locking ring and said sleeve against rotating on the axis of rotation of said shaft.

6. A gripper for processed elongate material comprising:

at least one movable gripper jaw;

a drive arrangement operatively linked to move said at least one gripper jaw, said drive arrangement including at least one adjustable-force drive, said at least one adjustable-force drive acting on said at least one gripper jaw via an intermediate link chain; and, said link chain includes a section operatively linked to move parallel and opposite direction relative to said adjustable-force drive's action.

7. A gripper for processed elongate material as claimed in claim 6 further comprising:

said at least one adjustable-force drive includes a fluid-pressure working cylinder, said fluid-pressure working cylinder including adjustable supply pressure.

8. The gripper for processed elongate material as claimed in claim 6 wherein:

said at least one movable gripper jaw has direction of movement with dominant radial component in relation to a line axis of gripping.

9. The gripper for processed elongate material as claimed in claim 6 wherein:

drive action of said at least one adjustable-force drive is predominantly parallel relative to a line axis of gripping, said link chain connected to provide force deflection to a direction of gripper jaw motion.

10. A twisting head for processed elongate material comprising:

a rotatable gripper configured to rotate about a line of gripping;

a drive, said drive being disposed in a fixed position;

a link chain operatively connected to said drive, said link chain including at least one section corotating with said rotatable gripper;

said gripper including at least one movable gripper jaw;

said drive acting on said at least one gripper jaw via said link chain; and, said link chain corotating section includes parts operatively linked to move in parallel and opposite direction relative to said drive's action.

11. A twisting head for processed elongate material as claimed in claim 10 further comprising:

a fork lever acting on said parts operatively linked to move in parallel and opposite direction relative to said drive's action; and, an interposed axial roller bearing disposed between said fork lever and said parts.

12. A twisting head for processed elongate material as claimed in claim 10 further comprising:

a fork lever acting on said parts operatively linked to move in parallel and opposite direction relative to said drive's action; and, an interposed pressure ring disposed between said fork lever and said parts.

13. A twisting head for processed elongate material as claimed in claim 10 further comprising:

a hollow cylindrical support structure, said parts and said at least one gripper jaw being mounted to said cylindrical support structure.

14. A twisting head for processed elongate material as claimed in claim 13 further comprising:

a recess in said hollow cylindrical support structure, said recess extending along a line of gripping.

15. A twisting head for processed elongate material as claimed in claim 13 further comprising:

a tubular sleeve at least partially covering said hollow cylindrical support structure; and, a lock controllably locking said tubular sleeve against rotation.

16. A twisting head for processed elongate material as claimed in claim 10 further comprising:

gripper surfaces on said at least one movable gripper jaw, said gripper surfaces being roughened surfaces.

17. A twisting head for processed elongate material as claimed in claim 16 further comprising:

said gripper surfaces are covered by hard material particles.

18. A twisting head for processed elongate material as claimed in claim 16 further comprising:

at least one elastic support fastened to at least one of said gripper surfaces.

19. A twisting head for processed elongate material as claimed in claim 10 further comprising:

a hollow cylindrical support structure, said parts and said at least one gripper jaw being mounted to said cylindrical support structure;

a second drive coupled to drive said rotatable gripper, said second drive being a rotary drive;

a shaft operatively connected to said hollow cylindrical support structure; and, a transmission between said second drive and said shaft.

20. A twisting head for processed elongate material as claimed in claim 19 further comprising:

said second drive having an output shaft, said output shaft being disposed laterally spaced from and parallel to a rotation axis of said rotatable gripper.

* * * * *